US008326613B2

(12) United States Patent
Gigi

(10) Patent No.: US 8,326,613 B2
(45) **Date of Patent: *Dec. 4, 2012**

(54) METHOD OF SYNTHESIZING OF AN UNVOICED SPEECH SIGNAL

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/868,314

(22) Filed: Aug. 25, 2010

(65) Prior Publication Data

US 2010/0324906 A1 Dec. 23, 2010

Related U.S. Application Data

(63) Continuation of application No. 10/527,776, filed on Mar. 14, 2005, now Pat. No. 7,805,295.

(30) Foreign Application Priority Data

Sep. 17, 2002 (EP) ..... 02078853

(51) Int. Cl.
*G10L 11/06* (2006.01)

(52) U.S. Cl. ..... 704/214; 704/207; 704/258; 704/205; 704/208; 704/211

(58) Field of Classification Search ..... 704/214, 704/208, 205, 207, 211, 258, 503; 84/661, 84/622, 659, 613, 619
See application file for complete search history.

(56) References Cited

U.S. PATENT DOCUMENTS 4,631,746 A * 12/1986 Bergeron et al. ..... 704/217
4,805,511 A * 2/1989 Schwartz ..... 84/627
4,809,330 A * 2/1989 Tanaka et al. ..... 704/216
5,018,200 A * 5/1991 Ozawa ..... 704/222
5,027,405 A * 6/1991 Ozawa ..... 704/223
5,150,387 A * 9/1992 Yoshikawa et al. ..... 375/240
5,241,650 A * 8/1993 Gerson et al. ..... 704/200
5,293,449 A * 3/1994 Tzeng ..... 704/223
5,307,441 A * 4/1994 Tzeng ..... 704/222
5,459,280 A * 10/1995 Masuda et al. ..... 84/622
5,479,564 A * 12/1995 Vogten et al. ..... 704/267
5,570,453 A * 10/1996 Gerson et al. ..... 704/219
5,581,652 A 12/1996 Abe et al.

(Continued)

FOREIGN PATENT DOCUMENTS

EP 0363233 A1 4/1990

(Continued)

OTHER PUBLICATIONS

Macon et al, An Enhanced ABS/OLA Sinusoidal Model for Waveform Synthesis in TTS, Proceedings Eurospeech '99, vol. 5, p. 2327-2330.

(Continued)

*Primary Examiner* — Vijay B Chawan

(57) ABSTRACT

The present invention relates to a method of synthesizing a signal comprising the steps of determining a required pitch bell locations, mapping the required pitch bell locations onto the signal to provide first pitch bell locations, randomizing the first pitch bell locations to provide second pitch bell locations, windowing the signal on the second pitch bell locations to provide a pitch bell, repeating the aforementioned steps for all required pitch bell locations and performing an overlap and add operation with respect to the pitch bells in order to synthesize the signal.

9 Claims, 3 Drawing Sheets

U.S. PATENT DOCUMENTS

Figure 1:
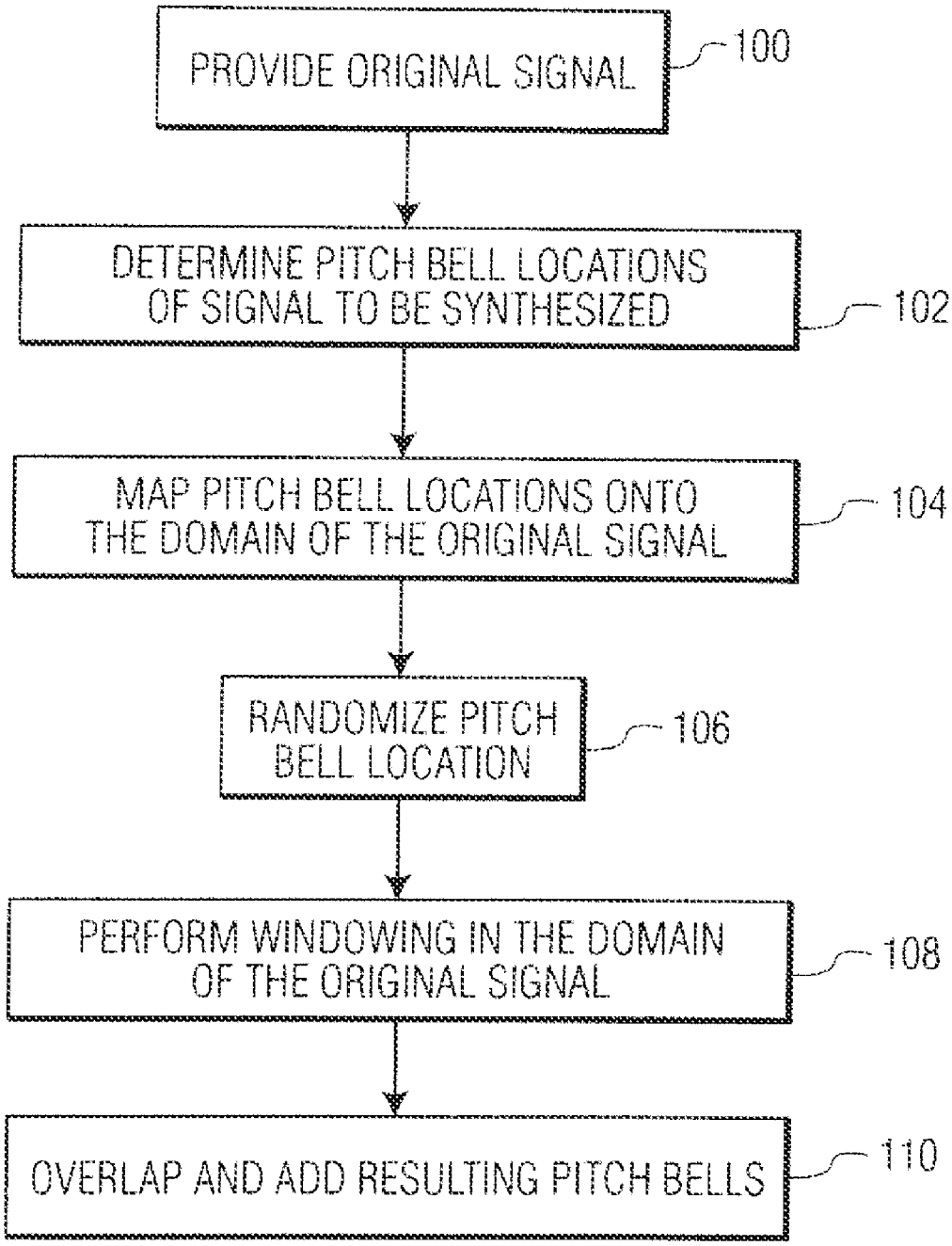

| | | | | | |
|---|---|---|---|---|---|
| 5,611,002 | A | * | 3/1997 | Vogten et al. | 704/267 |
| 5,659,661 | A | * | 8/1997 | Ozawa | 704/228 |
| 5,664,051 | A | | 9/1997 | Hardwick et al. | |
| 5,754,094 | A | * | 5/1998 | Frushour | 340/384.7 |
| 5,890,118 | A | * | 3/1999 | Kagoshima et al. | 704/265 |
| RE36,478 | E | * | 12/1999 | McAulay et al. | 704/206 |
| 6,011,211 | A | * | 1/2000 | Abrams et al. | 84/619 |
| 6,015,949 | A | * | 1/2000 | Oppenheim et al. | 84/613 |
| 6,064,962 | A | * | 5/2000 | Oshikiri et al. | 704/262 |
| 6,208,960 | B1 | * | 3/2001 | Gigi | 704/220 |
| 6,256,609 | B1 | * | 7/2001 | Byrnes et al. | 704/246 |
| 6,284,965 | B1 | * | 9/2001 | Smith et al. | 84/661 |
| 6,801,898 | B1 | * | 10/2004 | Koezuka | 704/500 |
| 6,963,833 | B1 | * | 11/2005 | Singhal et al. | 704/207 |
| 7,558,727 | B2 | * | 7/2009 | Gigi | 704/207 |
| 7,657,289 | B1 | * | 2/2010 | Levy et al. | 455/563 |
| 7,805,295 | B2 | * | 9/2010 | Gigi | 704/214 |

FOREIGN PATENT DOCUMENTS

| | | | |
|---|---|---|---|
| EP | 0363233 | B1 | 4/1990 |
| EP | 0706170 | A2 | 4/1996 |
| EP | 0706170 | B1 | 4/1996 |
| EP | 0706170 | A3 | 11/1997 |
| JP | 61292700 | A | 12/1986 |
| JP | 63199399 | A | 8/1988 |
| JP | 10214098 | A | 8/1998 |
| JP | 2001513225 | T | 8/2001 |
| WO | 9933050 | A2 | 7/1999 |

OTHER PUBLICATIONS

Eric Moulines et al, "Pitch-Synchronous Waveform Processing Techniques for Text-To-Speech Synthesis Using Diphones", Speech Communication, Elsevier Science Publishers, vol. 9, No. 5, Dec. 1, 1990, p. 453-467.

T. Dutoit et al, "MPB-PSOLA: Text-To-Speech Synthesis Based on an MBE Re-Synthesis of the Segments Database", Speech Communications 13, 1993, p. 435-440.

Window Functions. http://web.archive.org/web/20010504082441/http://www.cis.rit.edu/resources/software/sig_manual/windows.html, 2001.

* cited by examiner

METHOD OF SYNTHESIZING OF AN UNVOICED SPEECH SIGNAL

This is a continuation of prior application Ser. No. 10/527,776 filed Mar. 14, 2005 and is incorporated by reference herein.

The present invention relates to the field of synthesizing of speech or music, and more particularly without limitation, to the field of text-to-speech synthesis.

The function of a text-to-speech (TTS) synthesis system is to synthesize speech from a generic text in a given language. Nowadays, TTS systems have been put into practical operation for many applications, such as access to databases through the telephone network or aid to handicapped people. One method to synthesize speech is by concatenating elements of a recorded set of subunits of speech such as demi-syllables or polyphones. The majority of successful commercial systems employ the concatenation of polyphones. The polyphones comprise groups of two (diphones), three (triphones) or more phones and may be determined from nonsense words, by segmenting the desired grouping of phones at stable spectral regions. In a concatenation based synthesis, the conversation of the transition between two adjacent phones is crucial to assure the quality of the synthesized speech. With the choice of polyphones as the basic subunits, the transition between two adjacent phones is preserved in the recorded subunits, and the concatenation is carried out between similar phones.

Before the synthesis, however, the phones must have their duration and pitch modified in order to fulfil the prosodic constraints of the new words containing those phones. This processing is necessary to avoid the production of a monotonous sounding synthesized speech. In a TTS system, this function is performed by a prosodic module. To allow the duration and pitch modifications in the recorded subunits, many concatenation based TTS systems employ the time-domain pitch-synchronous overlap-add (TD-PSOLA) (E. Moulines and F. Charpentier, "Pitch synchronous waveform processing techniques for text-to-speech synthesis using diphones," Speech Commun., vol. 9, pp. 453-467, 1990) model of synthesis.

In the TD-PSOLA model, the speech signal is first submitted to a pitch marking algorithm. This algorithm assigns marks at the peaks of the signal in the voiced segments and assigns marks 10 ms apart in the unvoiced segments. The synthesis is made by a superposition of Hanning windowed segments centered at the pitch marks and extending from the previous pitch mark to the next one. The duration modification is provided by deleting or replicating some of the windowed segments. The pitch period modification, on the other hand, is provided by increasing or decreasing the superposition between windowed segments.

Despite the success achieved in many commercial TTS systems, the synthetic speech produced by using the TD-PSOLA model of synthesis can present some drawbacks, mainly under large prosodic variations.

EP-0363233, U.S. Pat. No. 5,479,564, EP-0706170 disclose PSOLA methods. A specific example is also the MBR-PSOLA method as published by T. Dutoit and H. Leich, in Speech Communication, Elsevier Publisher, November 1993, vol. 13, N.degree. 3-4, 1993. The method described in document U.S. Pat. No. 5,479,564 suggests a means of modifying the frequency by overlap-adding short-term signals extracted from this signal. The length of the weighting windows used to obtain the short-term signals is approximately equal to two times the period of the audio signal and their position within the period can be set to any value (provided the time shift between successive windows is equal to the period of the audio signal). Document U.S. Pat. No. 5,479,564 also describes a means of interpolating waveforms between segments to concatenate, so as to smooth out discontinuities. When a noisy signal is to be synthesized by means of a known PSOLA method, the signal is repeated periodically. This way an unintended periodicity is introduced into the frequency spectrum. This is perceived as a metallic sound. This problem occurs for all noisy signals which do not have a fundamental frequency, such as unvoiced speech parts or music. An unvoiced speech part, like the "s" sound, has no pitch. The vocal chords are not moving as they do for a voiced sound. Instead, a noisy hiss-sound is produced by pushing air through a small opening between the vocal chords. Whisper is an example of speech containing only unvoiced parts. Where there is no pitch, there is no need to change it. However, it can be desirable to change the duration of an unvoiced speech part.

The present invention therefore aims to provide a method of synthesizing a signal which enables to modify the duration of unvoiced speech parts or music without introducing an unintended periodicity in the signal.

The present invention provides for a method of synthesizing a signal, in particular a noisy signal, based on an original signal. Further the present invention provides for a computer program product for performing such a synthesis, as well as for a corresponding computer system, in particular, a text-to-speech system.

In accordance with the invention the required pitch bell locations of the signal to be synthesized are determined. This is done based on, for example, an assumed frequency of for example 100 Hz. This chosen frequency corresponds to a pitch period. The required pitch bell locations of the signal to synthesized are spaced apart on the time axis by intervals having the length of the pitch period. The required pitch bell locations are mapped onto the original signal to provide pitch bell locations in the domain of the original signal. The pitch bell locations in the domain of the original signal are randomly shifted. Preferably the randomization is performed by shifting the pitch bell locations in the original signal domain within +/− the pitch period.

In accordance with an embodiment of the invention the windowing is performed by means of a sine-window. The advantage of a sine-window is that it helps to reduce any residual periodicity. In particular using a sine-window is advantageous in that it ensures that the signal envelope in the power domain remains constant. Unlike a periodic signal, when two noise samples are added, the total sum can be smaller than the absolute value of any one of the two samples. This is because the signals are (mostly) not in-phase. The sine-window adjusts for this effect and removes the envelope-modulation.

Figure 2:
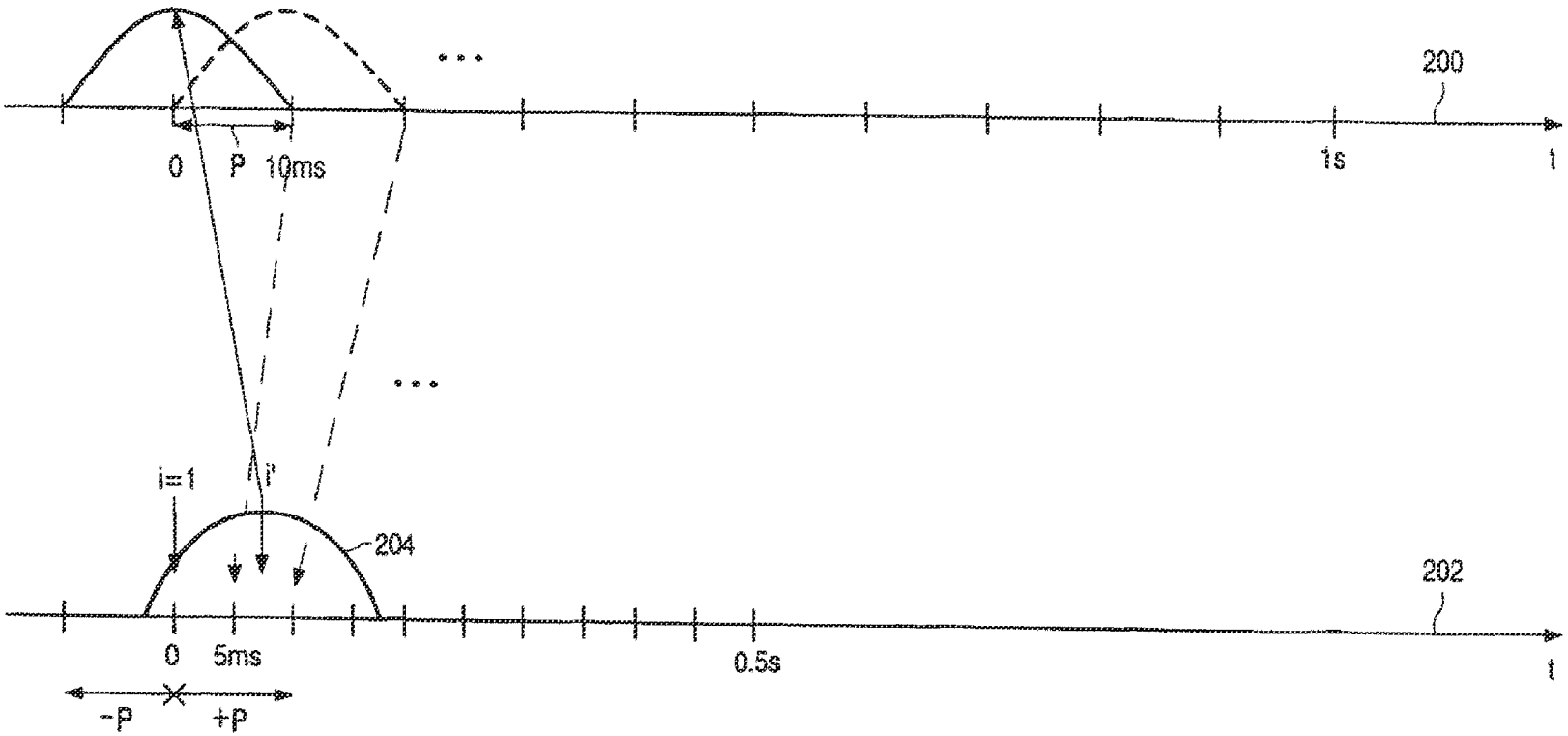
Figure 3:
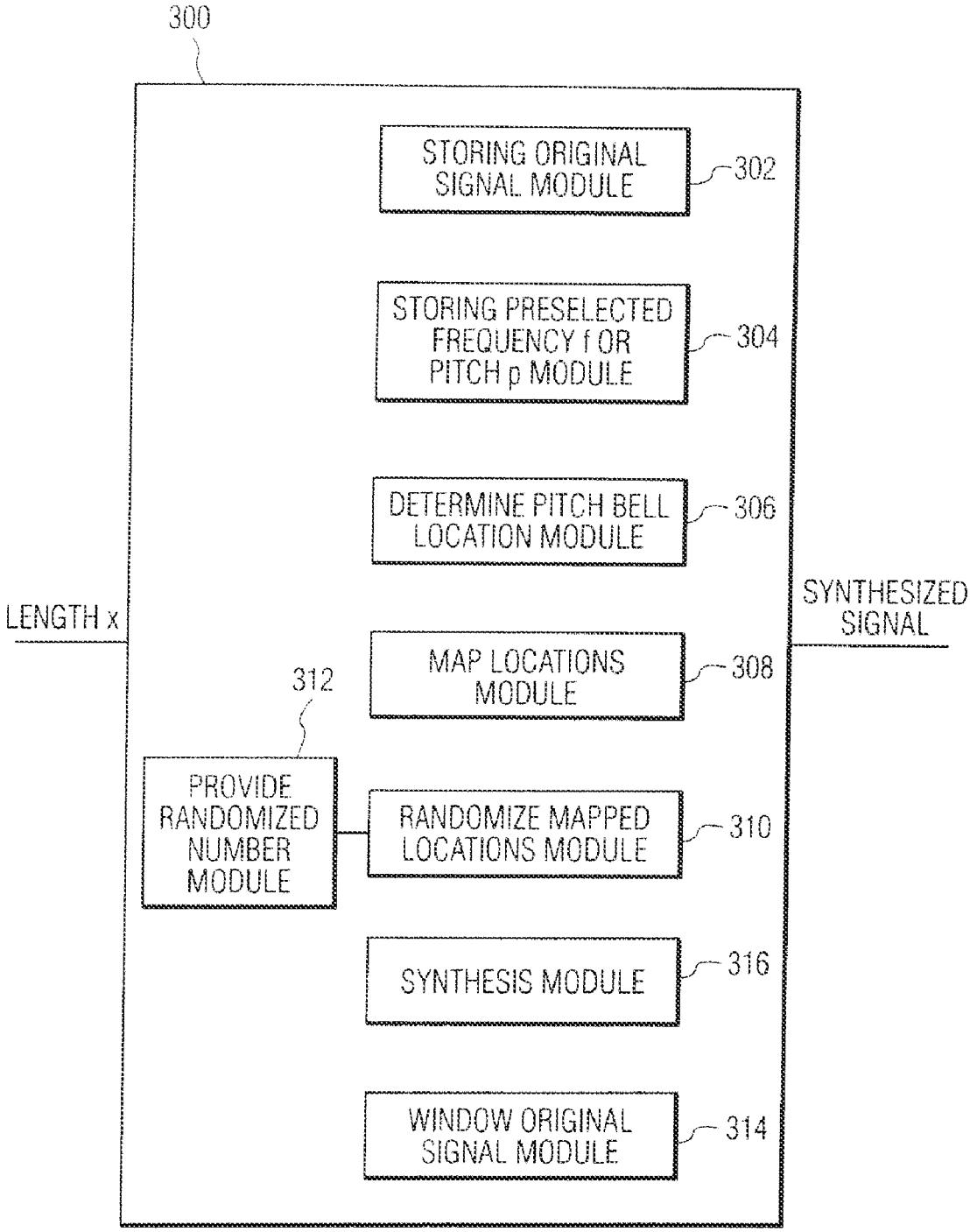

In the following, preferred embodiments of the invention are described in greater detail by making reference to the drawings in which:

FIG. 1 is illustrative of a flow chart of an embodiment of the present invention, FIG. 2 is illustrative of an example for synthesizing an unvoiced speech signal, FIG. 3 is a block diagram of a preferred embodiment of a computer system.

The flow chart of FIG. 1 is illustrative an embodiment of the method of synthesizing a signal. In step 100 an original signal having a duration of y is provided. For example, the original signal is a natural speech signal containing unvoiced speech or a music signal having a noisy signal characteristic. Further a choice for a fundamental frequency f is made even though the original signal does not have such a fundamental frequency because of its noisy characteristics. The choice of a frequency f corresponds to a choice of a pitch period p. A convenient choice for a frequency f is between 50 Hz and 200 Hz, preferably 100 Hz. In addition the desired duration x of the signal to be synthesized is inputted in step 100. In step 102 the pitch bell locations in the domain of the signal to be synthesized are determined in accordance with the choice of frequency f and pitch period p. This is done by dividing the time axis in the domain of the signal to synthesized into intervals of length p. In step 104 the pitch bell locations are mapped from the domain of the signal to be synthesized onto the domain of the original signal. When the duration x is longer than the duration y of the original signal this means that the pitch bell locations i in the domain of the original signal are spaced apart by intervals which are shorter than the pitch period p. In the opposite case the intervals between the pitch bell locations i in the domain of the original signal will be longer than the intervals between the pitch bell locations and the domain of the signal to be synthesized. In step 106 the pitch bell locations i in the domain of the original signal are randomized. This can be done by randomly shifting each of the pitch bell location i within an interval of +/− p around the original pitch bell location i. A pseudo random number generator can be utilized to perform this randomization. In step 108 the windowing is performed in the domain of the original signal. Preferably this is done by means of a sine-window which is applied on the randomized pitch bell locations i'; this way periodicity is further reduced. In step 110 the resulting pitch bells are overlapped and added in the domain of the signal to be synthesized which provides the synthesized signal.

FIG. 2 illustrates this signal synthesis by way of example. Time axis 200 is in the domain of the signal to be synthesized. The required duration x of the signal to be synthesized is one second in the example considered here. The assumed frequency f is 100 Hz, which corresponds to a pitch period p of 10 milliseconds. This means that the required pitch bell locations in the domain of the signal to be synthesized on time axis 200 are spaced apart by intervals of p=10 milliseconds, i.e. the first pitch bell location is located at zero seconds on time axis 200, the next pitch bell location is at 10 milliseconds, the following at 20 milliseconds and so on. In other words the pitch bell locations in the domain of the signal to be synthesized are determined by points on the time axis 200 which are spaced apart by intervals of p starting at time zero. The pitch bell locations on time axis 200 are mapped onto time axis 202 in the domain of the original signal. The original signal has a duration of y=0.5 seconds. As the duration y is smaller than the duration x of the signal to be synthesized this means that the pitch bell locations need to be "compressed" on time axis 202. As the duration y is half the duration x the intervals of the mapped pitch bell locations on the time axis 202 are spaced apart by p/2 instead of p. This means that the first pitch bell location i=1 is at zero milliseconds on the time axis 202; the following pitch bell location i=2 is at 5 milliseconds, the next pitch bell location i=3 is at 10 milliseconds and so on. In other words the first pitch bell location at time zero milliseconds on the time axis 200 is mapped onto the pitch bell location i=1 on the time axis 202 at zero milliseconds; the required pitch bell location at 10 milliseconds on the time axis 200 is mapped on the pitch bell location i=2 at 5 milliseconds on the time axis 202; the required pitch bell location at 20 milliseconds on the time axis 200 is mapped onto the pitch bell location i=3 at time 10 milliseconds on the time axis 202 and so on. Next the pitch bell locations i are randomized. This is illustrated in FIG. 2 with respect to the first pitch bell location i=1 on the time axis 202. An interval of +/−p around zero milliseconds is defined on the time axis 202. Within this interval the pitch bell location i=1 is randomly shifted. For the pitch bell location i=1 the interval is between −10 milliseconds to +10 milliseconds on the time axis 202. In the example considered here this results in a randomized pitch bell location i' at 7.5 milliseconds on the time axis 202. At this position the original signal is windowed by means of a window function 204. Preferably the following window is used to provide a window function 204.

$$w[n] = \sin\left(\frac{\pi \cdot (n + 0.5)}{m}\right), 0 \le n \ge m$$

Preferably the randomization of the pitch bell locations i is performed in accordance with the following formula:

$$i' = i + (R \times p)$$

Where i denotes the original pitch bell location on the time axis 202, i' is the new pitch bell location after the randomization, R is a random number between −1 and 1 and p is the pitch period. The result of the windowing of the original signal is a pitch bell. This pitch bell is placed at the first required pitch bell location within the domain of the signal to be synthesized on time axis 200 as illustrated in FIG. 2. This process is repeated with respect to all required pitch bells on the time axis. These pitch bells are added which yields the desired synthesized signal of length x.

FIG. 3 is illustrative of a block diagram of a computer system, such as a text-to-speech system. The computer system 300 has a module 302 for storing an original signal having a duration of y. Further the computer system 300 has a module 304 for storing a pre-selected frequency for pitch p. Module 306 serves to determine required pitch bell locations of the signal to be synthesized based on the required duration x of the signal to be synthesized and the pre-selected frequency for pitch p. Module 308 serves to map the required pitch bell locations in the domain of the signal to be synthesized onto the domain of the original signal. This way the pitch bell locations i are determined as illustrated in the example of FIG. 2. Module 310 serves to randomize the pitch bell locations i. Module 310 is coupled to module 312 which provides random numbers for the randomization process. Module 314 serves to perform the windowing of the original signal on the randomized pitch bell locations i'. The resulting pitch bells are then overlapped and added in the domain of the signal to be synthesized by mean of module 316. This results in the synthesized signal of the desired duration y.

List of Reference Numerals time axis 200 time axis 202 window function 204 computer system 300 module 302 module 304 module 306 module 308 module 310 module 312 module 314 module 316

The invention claimed is:

1. A method, operable in a computer system, for synthesizing a signal, the method comprising the steps of:

a) determining required pitch bell locations in accordance with a desired frequency and pitch period, a length of said pitch period being based on a duration of the signal;

b) mapping the required pitch bell locations onto the signal to provide a first set of pitch bell locations, c) randomly shifting the first set of pitch bell locations to provide a second set of pitch bell locations, d) windowing the signal on the second set of pitch bell locations to provide corresponding pitch bells, e) repeating steps a) to d) for each of the required pitch bell locations and performing an overlap and add operation with respect to the pitch bells in order to synthesize the signal.

2. The method of claim 1 the determination of required pitch bell locations comprises:

dividing the required length of the signal to be synthesized into time intervals, each of the time intervals having the length of said pitch period.

3. The method of claim 1, whereby the step of randomly shifting the first pitch bell locations comprises:

randomly shifting each of the first pitch bell locations within an interval of +/− the pitch period.

4. The method of claim 1, whereby the step of randomly shifting the first pitch bell locations comprises:

randomly shifting a first pitch bell location i to provide a corresponding second pitch bell location i' in accordance with the following equation:

$$i'=i+(R\times p),$$

where R is a random number between −1 and +1 and p is the pitch period.

5. The method of claim 1, whereby the step of windowing is performed using a sine-window.

6. The method of claim 1, whereby the step of windowing is performed as:

$$w[n] = \sin\left(\frac{\pi\cdot(n+0.5)}{m}\right),\ 0 \le n < m$$

where m is the length of the window and n is a running index.

7. The method of claim 1, whereby the signal does not have a fundamental frequency, and the signal, preferably comprising unvoiced speech or music.

8. A computer program product, in particular digital storage medium, comprising program means, which when accessed by a computer system causes the computer system to perform the steps of:

a) determining required pitch bell locations in accordance with a desired frequency and pitch period, said pitch period being based on a duration of the signal, b) mapping of the required pitch bell location onto the signal to provide corresponding first pitch bell locations, c) randomizing the first pitch bell locations to provide second pitch bell locations, d) windowing the signal on the second pitch bell locations to provide pitch bells, e) repeating of steps a) to d) for all pitch bell locations and performing an overlap and add operation with respect to the pitch bells in order to synthesize the signal.

9. A text-speech synthesis computer system for synthesizing a signal, the computer system comprising:

means for determining required pitch bell locations in accordance with a desired frequency and pitch period, means for mapping the required pitch bell locations onto the signal to provide first pitch bell locations (i), means for randomizing the first pitch bell locations to provide second pitch bell locations (i'), means for windowing the signal on the second pitch bell locations to provide pitch bells, means for performing an overlap and add operation with respect to the pitch bells in order to synthesize the signal.

* * * * *